US007861871B2

(12) United States Patent
Kao

(10) Patent No.: US 7,861,871 B2
(45) Date of Patent: Jan. 4, 2011

(54) HAND TOOL RACK

(76) Inventor: Jui-Chien Kao, No. 358, Tunghsing Rd., Shuwang Li, Tall City, Taichung Hsien (TW)

( * ) Notice: Subject to any disclaimer, the term of this patent is extended or adjusted under 35 U.S.C. 154(b) by 14 days.

(21) Appl. No.: 12/411,456

(22) Filed: Mar. 26, 2009

(65) Prior Publication Data

US 2009/0184070 A1 Jul. 23, 2009

Related U.S. Application Data

(63) Continuation-in-part of application No. 11/496,613, filed on Jul. 31, 2006, now abandoned.

(51) Int. Cl.
*A47F 7/00* (2006.01)

(52) U.S. Cl. ..... 211/70.6; 211/60.1; 211/89.01; 206/349; 206/372; 206/373

(58) Field of Classification Search ..... 211/60.1, 211/70.6, 89.01; 206/349, 372, 373, 377, 206/378, 379
See application file for complete search history.

(56) References Cited

U.S. PATENT DOCUMENTS 2,754,974 A * 7/1956 Larson ..... 211/70.6
4,467,925 A * 8/1984 Ratzloff et al. ..... 211/70.6
5,109,992 A * 5/1992 Miller ..... 211/59.1
5,992,626 A * 11/1999 Anderson ..... 206/378
6,431,373 B1 * 8/2002 Blick ..... 211/70.6
6,637,605 B2 * 10/2003 Ernst ..... 211/70.6
6,679,379 B1 * 1/2004 Kao ..... 206/349
6,732,989 B1 * 5/2004 Kao ..... 248/309.1
6,834,767 B1 * 12/2004 Lin ..... 211/70.6
2004/0020810 A1 * 2/2004 Kao ..... 206/376
2004/0020880 A1 * 2/2004 Kao ..... 211/70.6
2004/0173485 A1 * 9/2004 Huang ..... 206/349
2004/0217032 A1 * 11/2004 Cunningham et al. ..... 206/461
2005/0098461 A1 * 5/2005 Kao ..... 206/372
2007/0007222 A1 * 1/2007 Kao ..... 211/70.6
2008/0023420 A1 * 1/2008 Kao ..... 211/70.6
2008/0041801 A1 * 2/2008 Kao ..... 211/70.6
2008/0047911 A1 * 2/2008 Kao ..... 211/70.6

* cited by examiner

*Primary Examiner*—Darnell M Jayne
*Assistant Examiner*—Patrick Hawn
(74) *Attorney, Agent, or Firm*—Frenkel & Associates, PC

(57) ABSTRACT

A hand tool rack has an elongated base bracket, multiple clamping elements, two hangers and a lock. The base bracket has a baseboard and a rail bracket. The rail bracket is detachably mounted on the baseboard. The clamping elements are movably mounted on the rail bracket of the base bracket. The hangers are movably mounted on the base bracket and each hanger has two mounting arms and a hanging arm. The mounting arms of the each hanger are clamped on the baseboard. The hanging arm is formed with the mounting arms of the hanger for hanging on a tool cart. The lock is detachably connected to the base bracket to provide a burglarproof effect and has a display clamp and a container clamp. The display clamp has a display panel and a catching bracket. The container clamp has a container panel and a container casing.

4 Claims, 14 Drawing Sheets

HAND TOOL RACK

The present invention is a continuation-in-part of application Ser. No. 11/496,613, filed on Jul. 31, 2006.

BACKGROUND OF THE INVENTION

1. Field of the Invention

The present invention relates to a tool rack, and more particularly to a hand tool rack that can avoid interference between two adjacent tools when positioning the tool on the tool rack, can be mounted on a tool cart and can provide a burglarproof effect.

2. Description of the Prior Art

A conventional hand tool rack is suspended on a wall, so that hand tools can be organized to facilitate work efficiency and prevent loss of tools. The conventional hand tool rack is provided with an elongated rack adapted for connection to a wall and multiple clamping elements firmly formed on the elongated rack. Each clamping element includes a through hole defined to mount a shank of the hand tool.

However, when multiple racks are mounted on the wall, only limited space is available for inserting hand tools into the through holes in the clamping elements. Therefore, the racks must be adjusted and moved to clear space for insertion of additional hand tools, which is troublesome and a waste of time as well as energy. Besides, the clamping elements are firmly mounted on the rack and cannot be moved to maximize utility of available space on the rack. In addition, the conventional hand tool rack only can be mounted on the wall by threaded bolts and cannot be mounted on a tool cart so limiting the usage of the hand tool rack.

To overcome the shortcomings, the present invention tends to provide an improved hand tool rack to mitigate the aforementioned problems.

SUMMARY OF THE INVENTION

The main objective of the present invention is to provide a hand tool rack that avoids interference between two adjacent tools when positioning the tools on the tool rack, can be mounted on a tool cart and provides a burglarproof effect.

The hand tool rack in accordance with the present invention has an elongated base bracket, multiple clamping elements, two hangers and a burglarproof device. The base bracket has a baseboard and a rail bracket. The rail bracket is detachably mounted on the baseboard. The clamping elements are movably mounted on the rail bracket of the base bracket. The hangers are movably mounted on the base bracket and each hanger has two mounting arms and a hanging arm. The mounting arms of the each hanger are clamped on the baseboard. The hanging arm is formed with the mounting arms of the hanger for hanging with a tool cart. The burglarproof device is detachably connected to the base bracket to provide a burglarproof effect and has a display clamp and a container clamp. The display clamp is detachably connected to a proximal end of the base bracket and has a display panel and a catching bracket. The container clamp is detachably connected to a distal end of the base bracket for storing fasteners and has a container panel and a container casing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
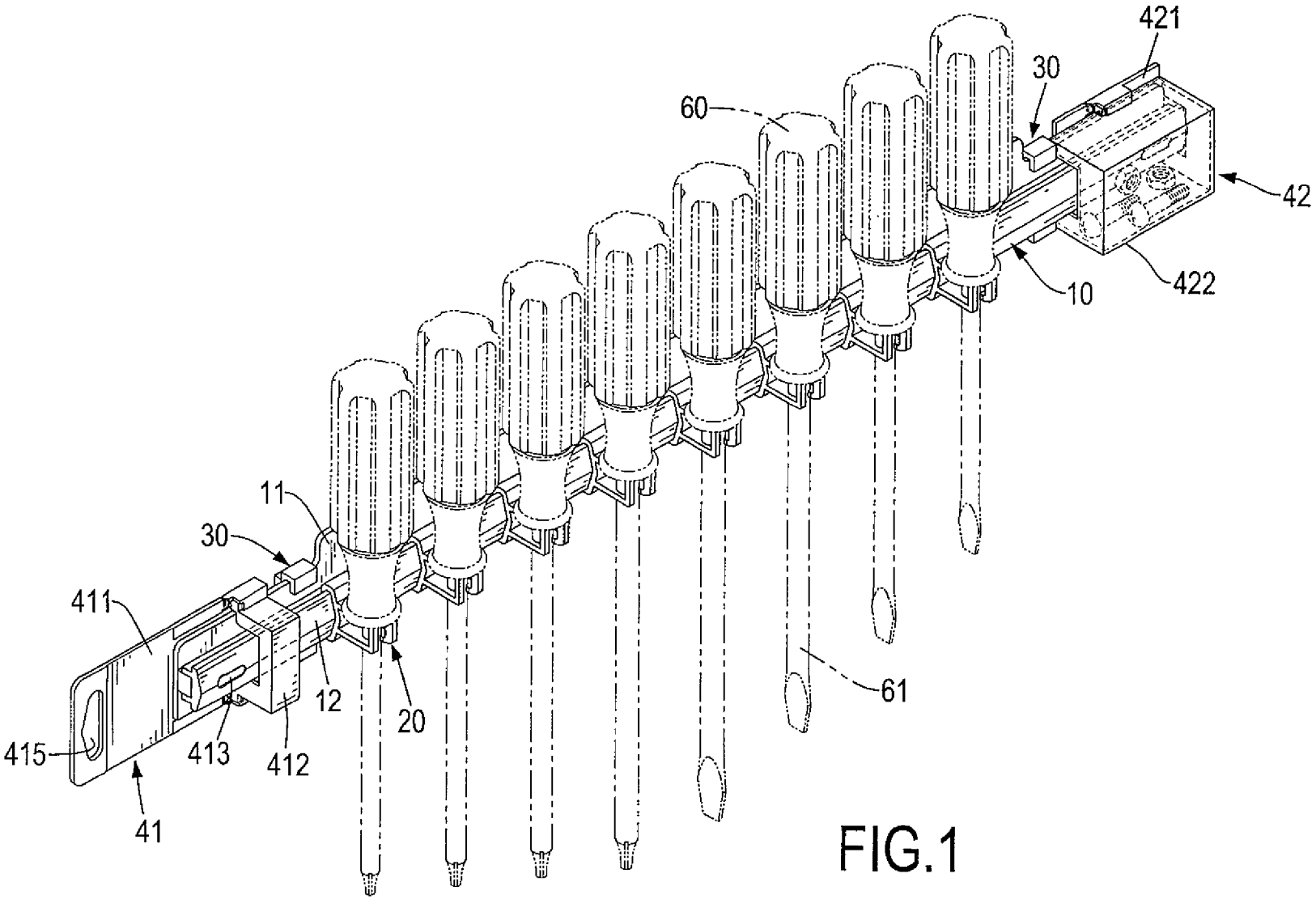
FIG. 1 is a perspective view of a hand tool rack in accordance with the present invention, showing hand tools clamped by the rack in phantom lines.
Figure 2:
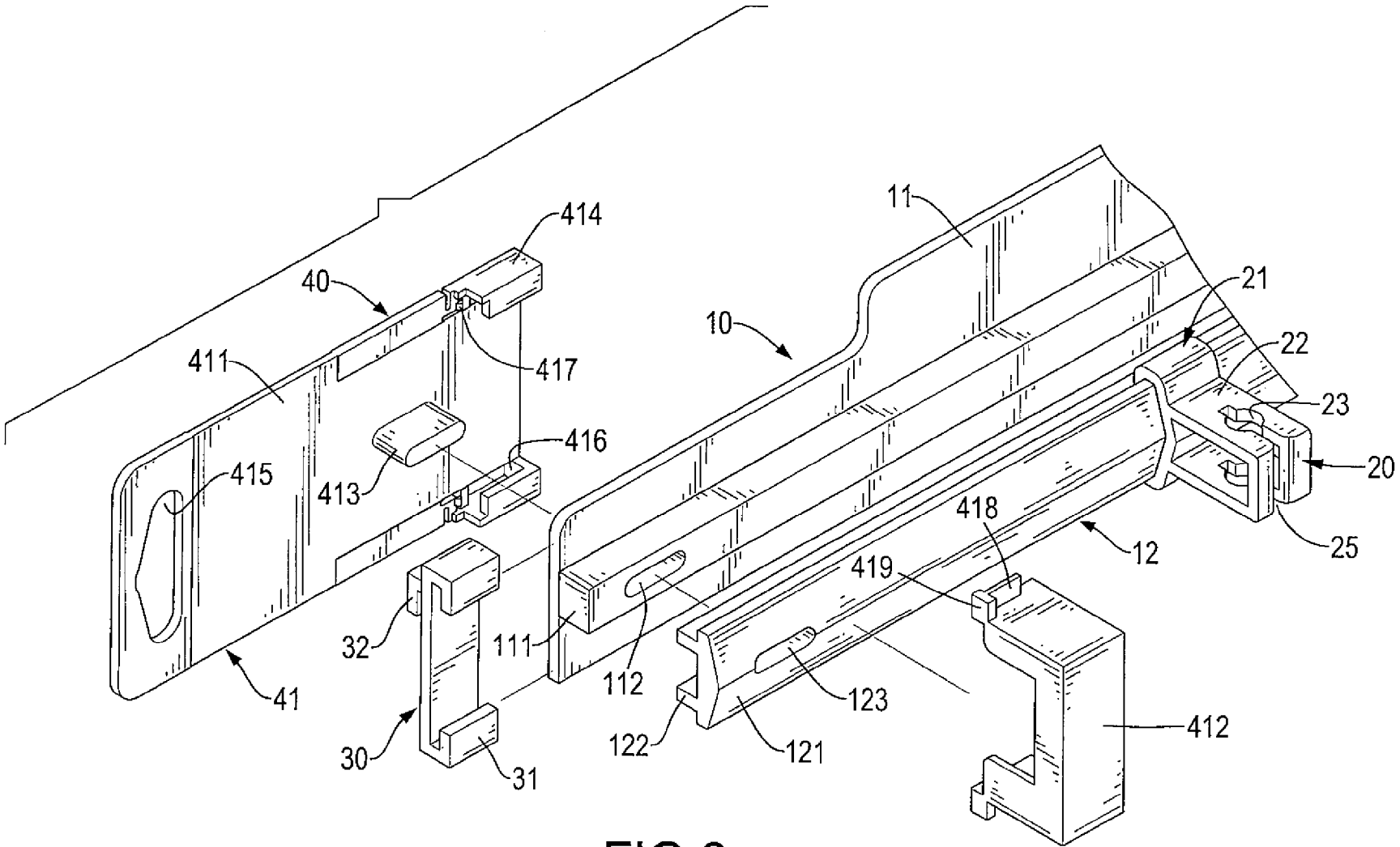
FIG. 2 is an enlarged exploded perspective of the hand tool rack in FIG. 1.
Figure 3:
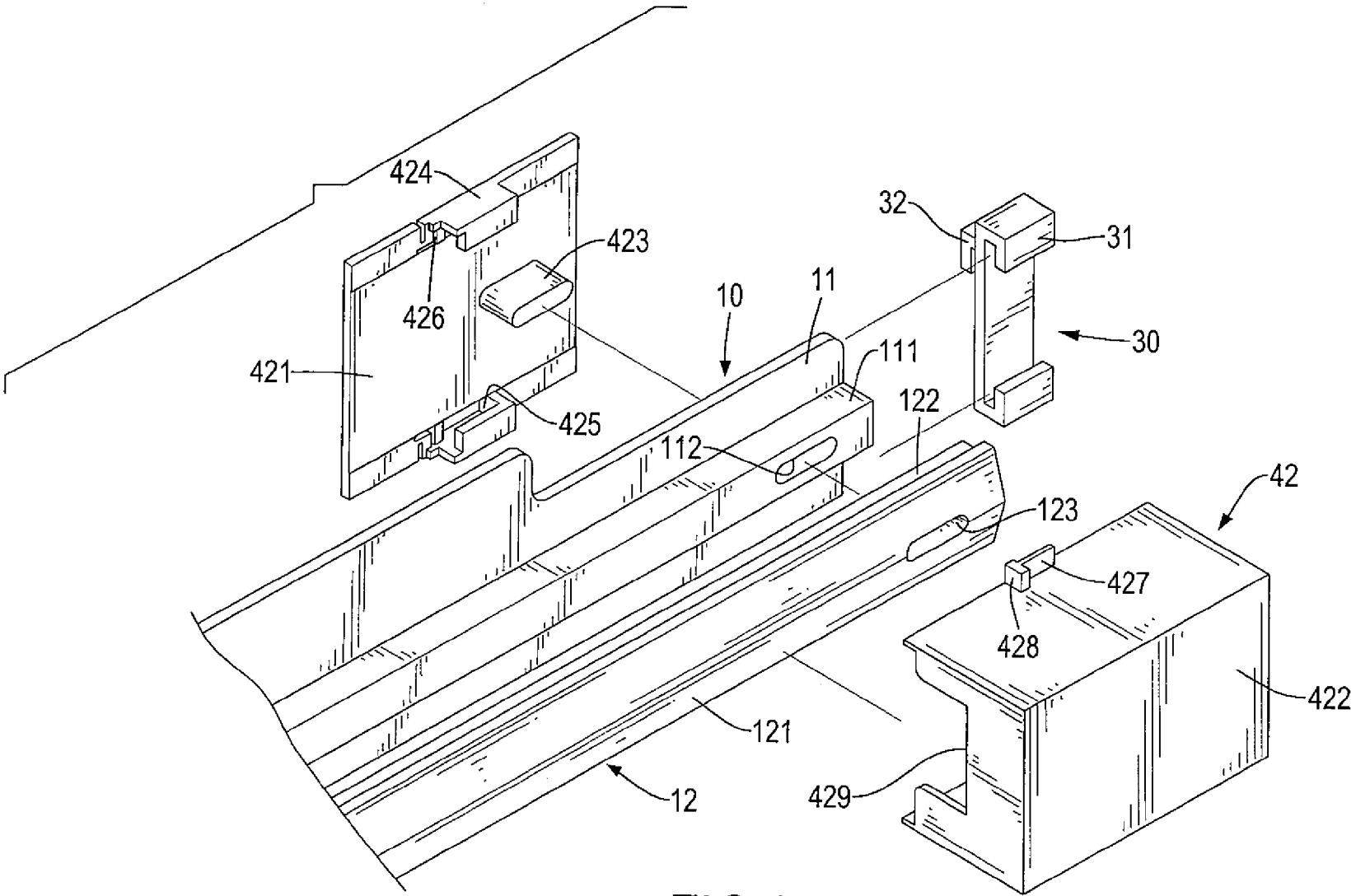
FIG. 3 is another enlarged exploded perspective of the hand tool rack in FIG. 1.
Figures 4A, 4B:
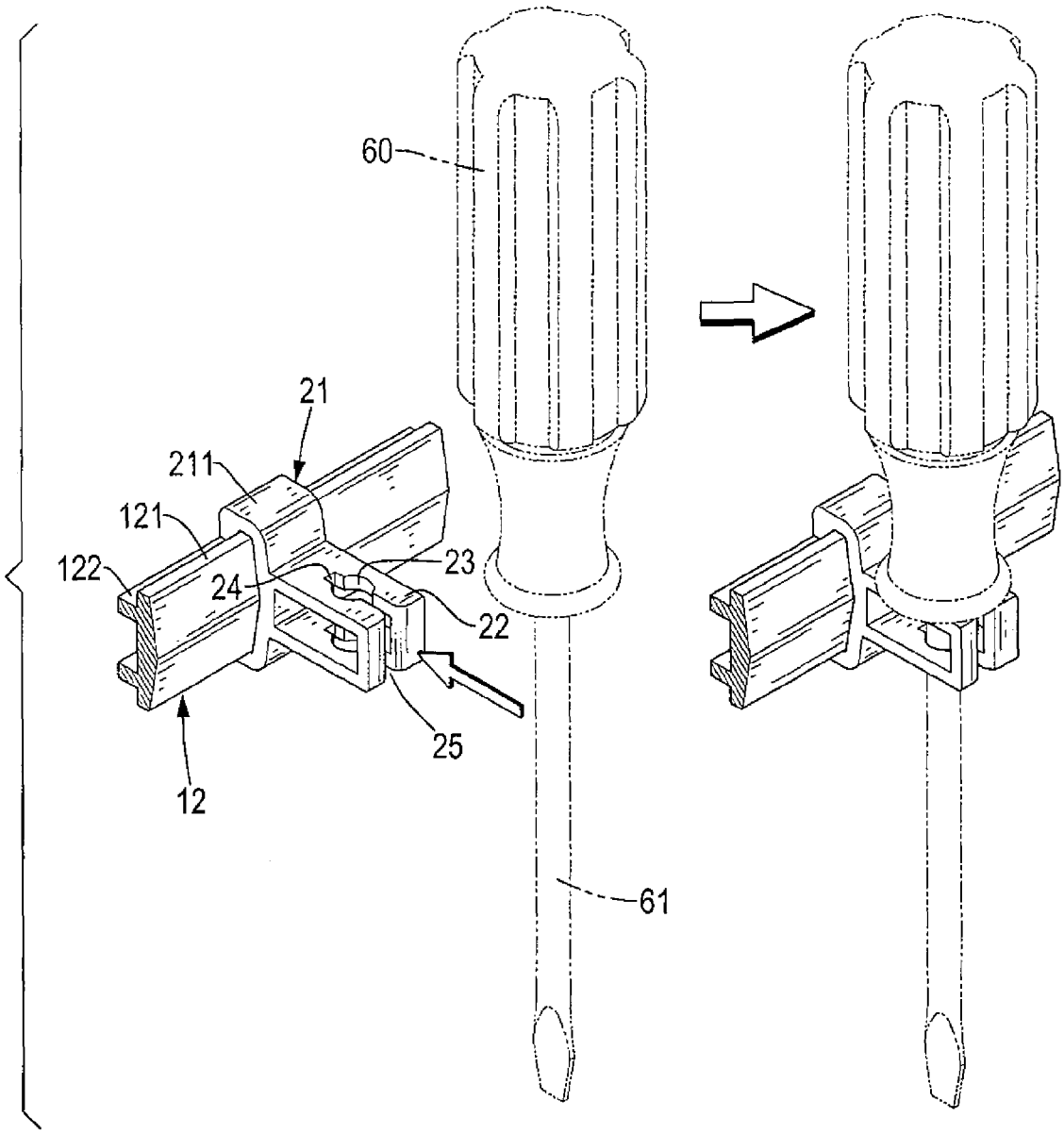
FIGS. 4A and 4B are perspective views showing a portion of the hand tool rack in FIG. 1, wherein a hand tool is inserted in a first embodiment of a clamping element of the present invention.

With reference to FIGS. 1 to 3, 12A, 12B and 13A, a hand tool rack in accordance with the present invention for holding hand tools (60) has an elongated base bracket (10), multiple clamping elements (20, 20A, 20B), two hangers (30) and a lock (40).

The base bracket (10) may be hung on a surface such as a wall (70) or a sidewall (91) of a tool cart (90) and has two ends, a baseboard (11) and a rail bracket (12).

The baseboard (11) has a front surface, a rear surface, a connecting bar (111) and two elongated holes (112). The connecting bar (111) is longitudinally formed on and protrudes from the front surface of the baseboard (11) and has a front surface and two ends. The elongated holes (112) are respectively formed through the connecting bar (111) and the baseboard (11) near the ends of the connecting bar (111).

The rail bracket (12) is detachably mounted on the baseboard (11) and has a rail (121) and two mounting panels (122). The rail (121) is mounted on the front surface of the connecting bar (111) of the baseboard (11) and has a rear surface, two ends and two connecting holes (123). The connecting holes (123) are respectively formed through the rail (121) near the ends and align with the elongated holes (112) of the baseboard (11). The mounting panels (122) are respectively formed on and protrude from the rear surface of the rail (121) parallel to each other and are mounted on opposite sides of the connecting bar (111) of the baseboard (11).

Figure 5:
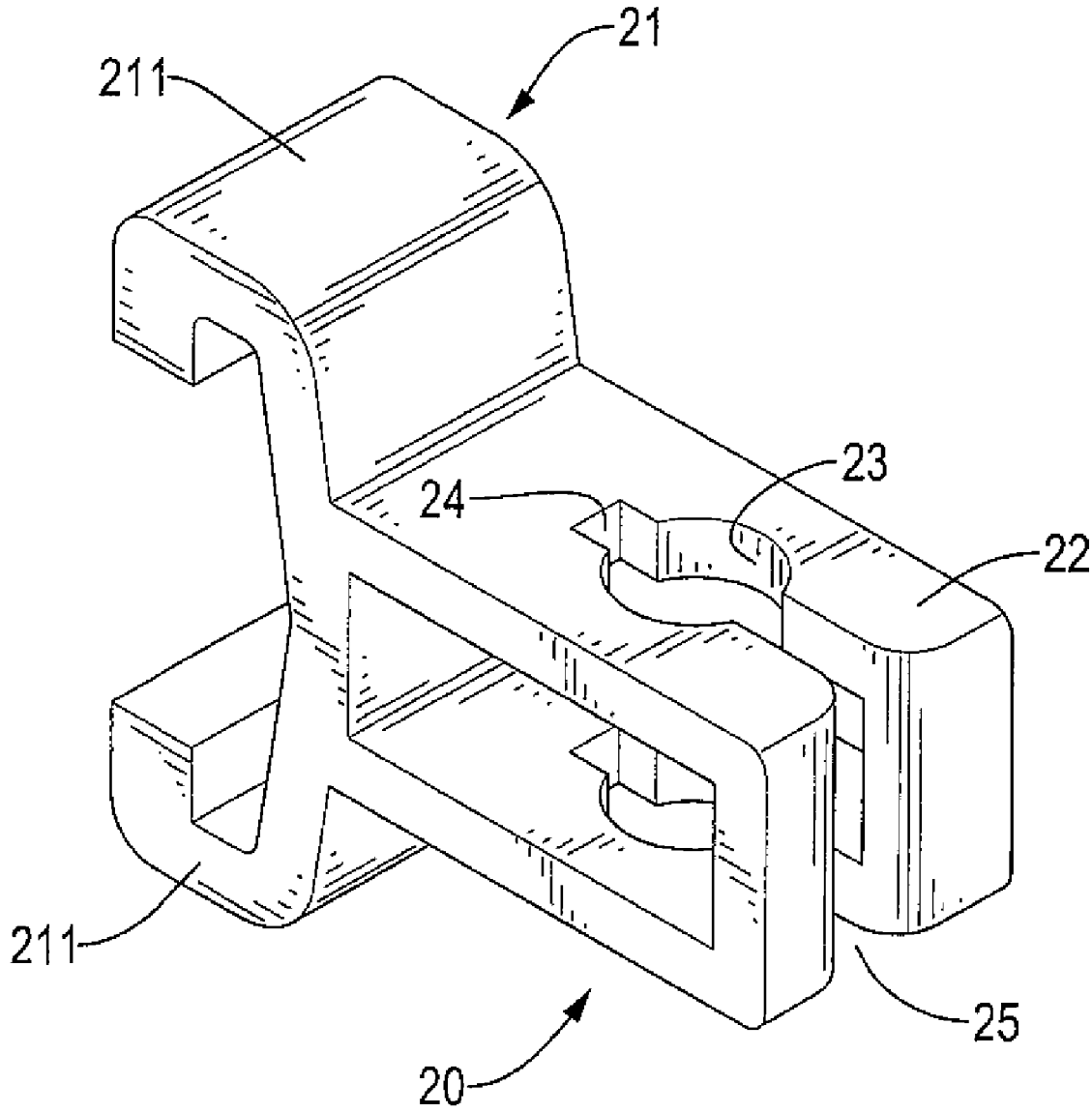
FIG. 5 is a perspective view of the clamping element in FIGS. 4A and 4B.
Figure 6A:
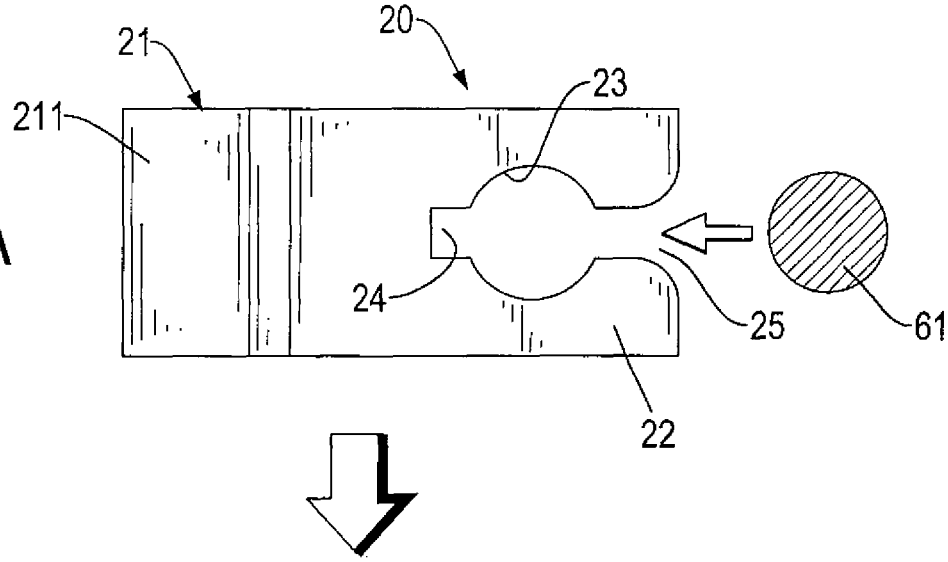
FIGS. 6A, 6B and 6C are top views in cross section showing the attachment/detachment of the hand tool by the clamping element in FIG. 5.
Figure 6B:
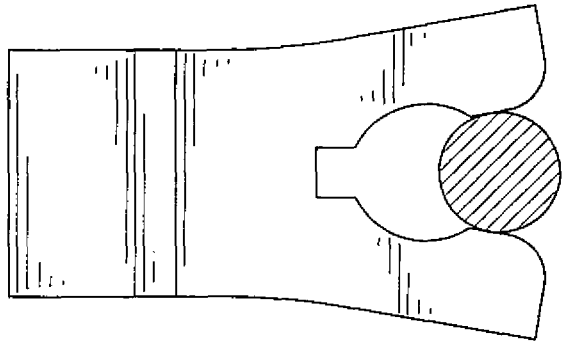
Figure 6C:
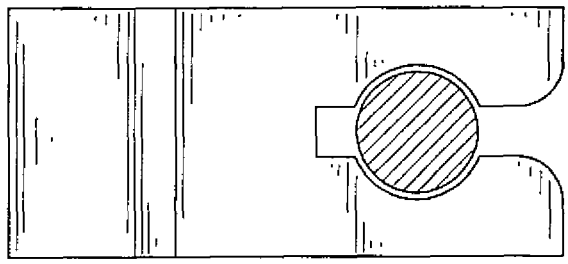
Figures 7A, 7B:
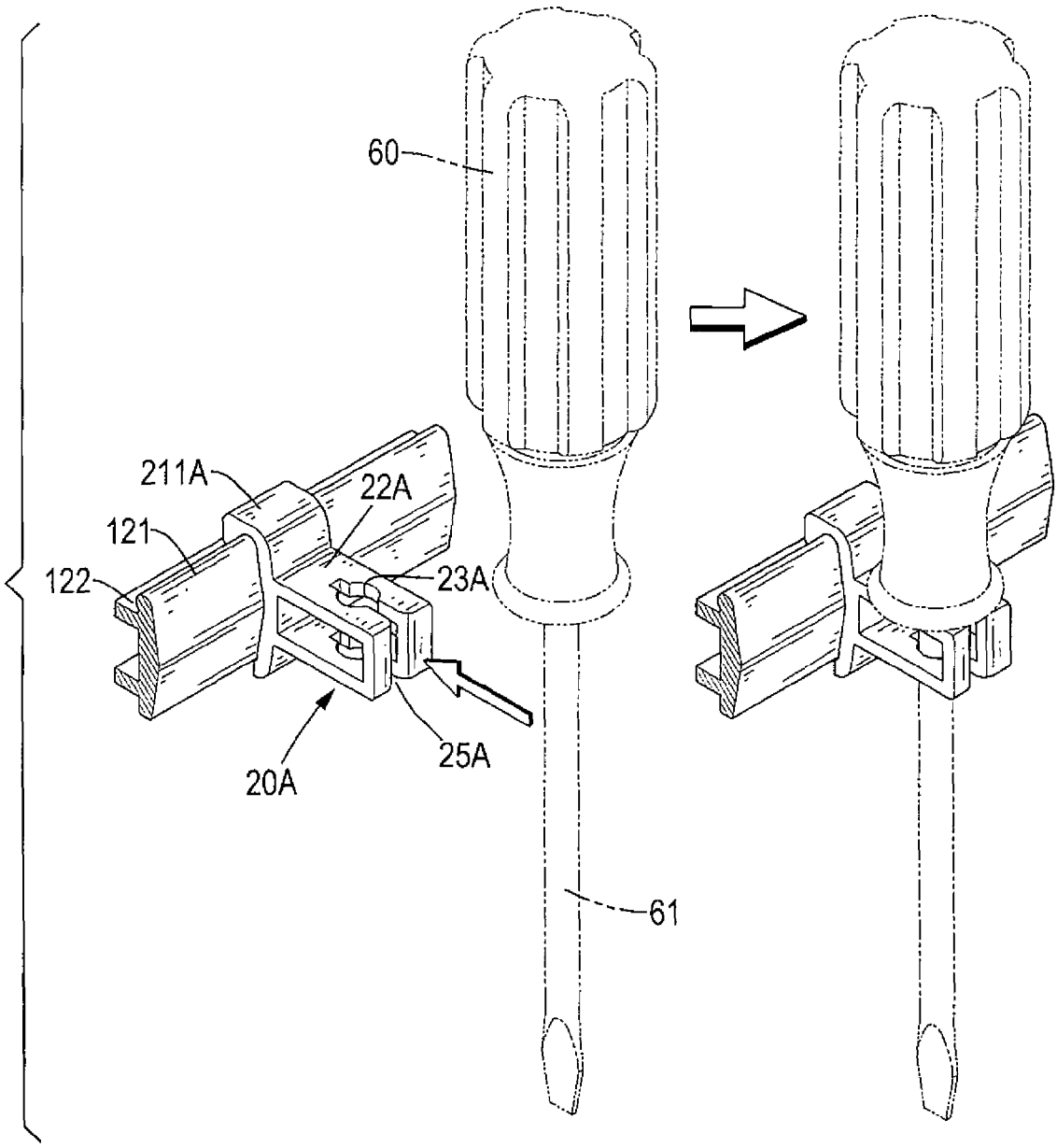
FIGS. 7A and 7B are perspective views showing a portion of the hand tool rack in FIG. 1, wherein a hand tool is inserted in a second embodiment of a clamping element of the present invention.
Figure 8:
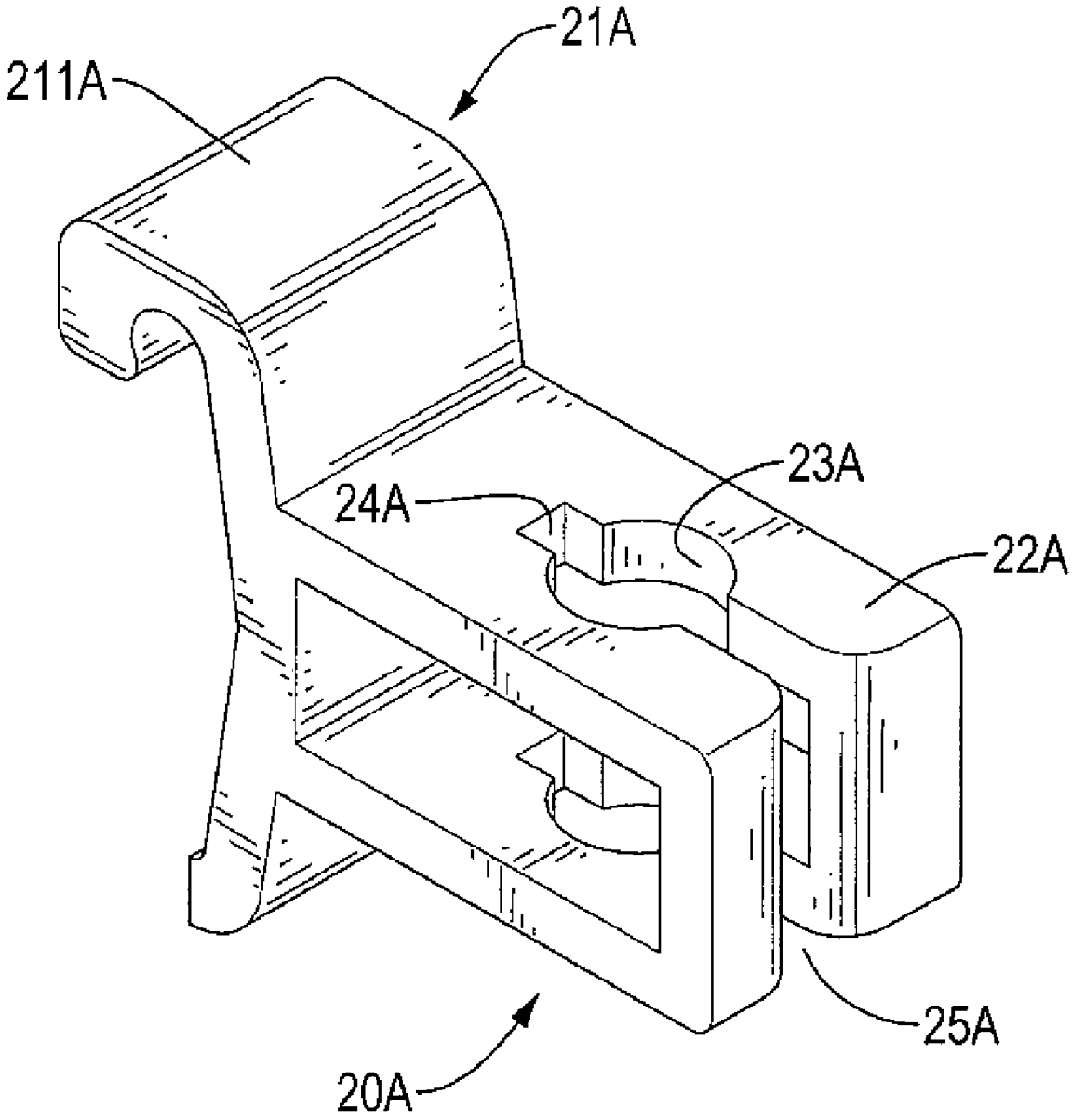
FIG. 8 is a perspective view of the clamping element in FIGS. 7A and 7B.
Figures 9A, 9B:
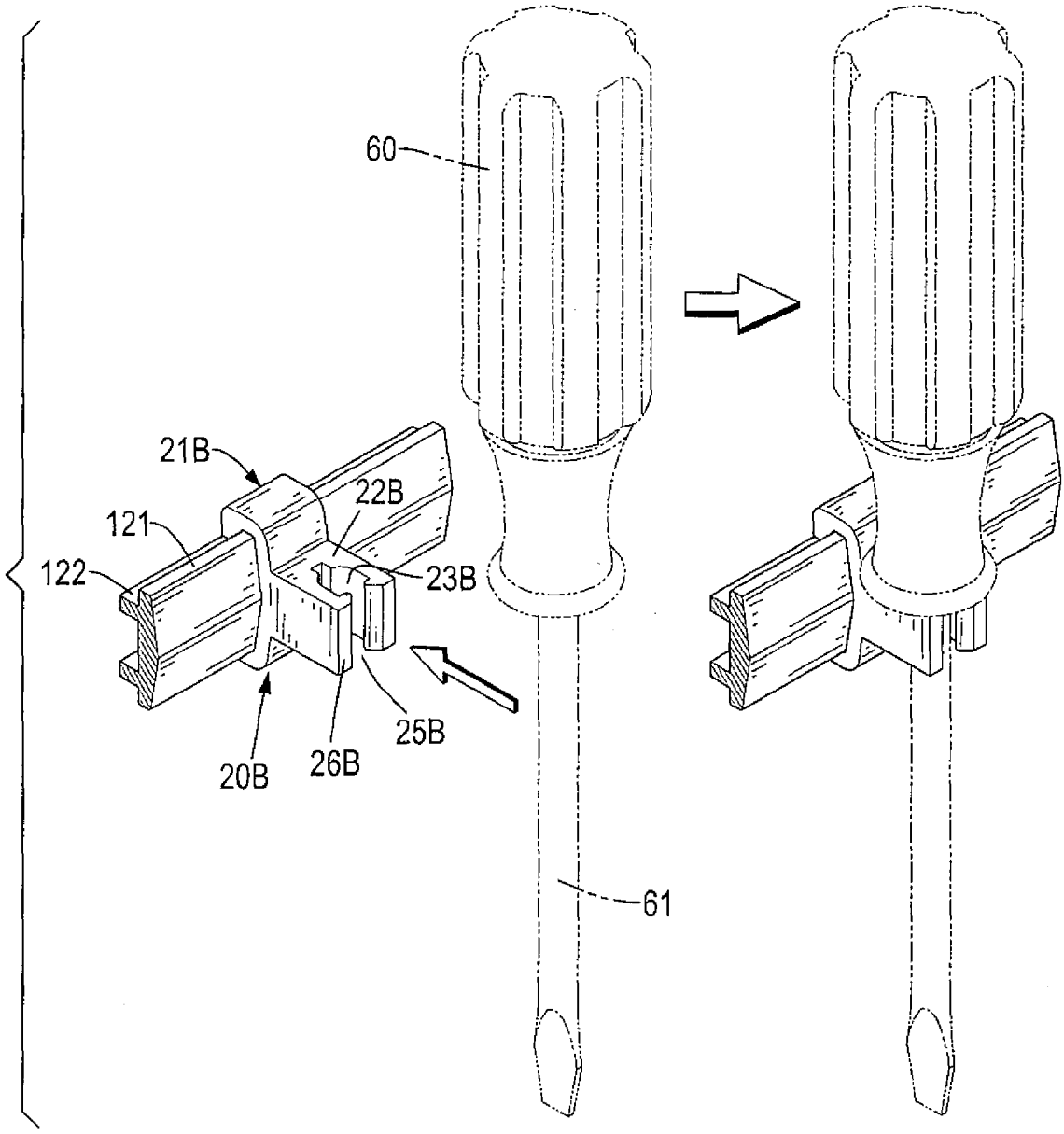
FIGS. 9A and 9B are perspective views showing a portion of the hand tool rack in FIG. 1, wherein a hand tool is inserted in a third embodiment of a clamping element of the present invention.
Figure 10:
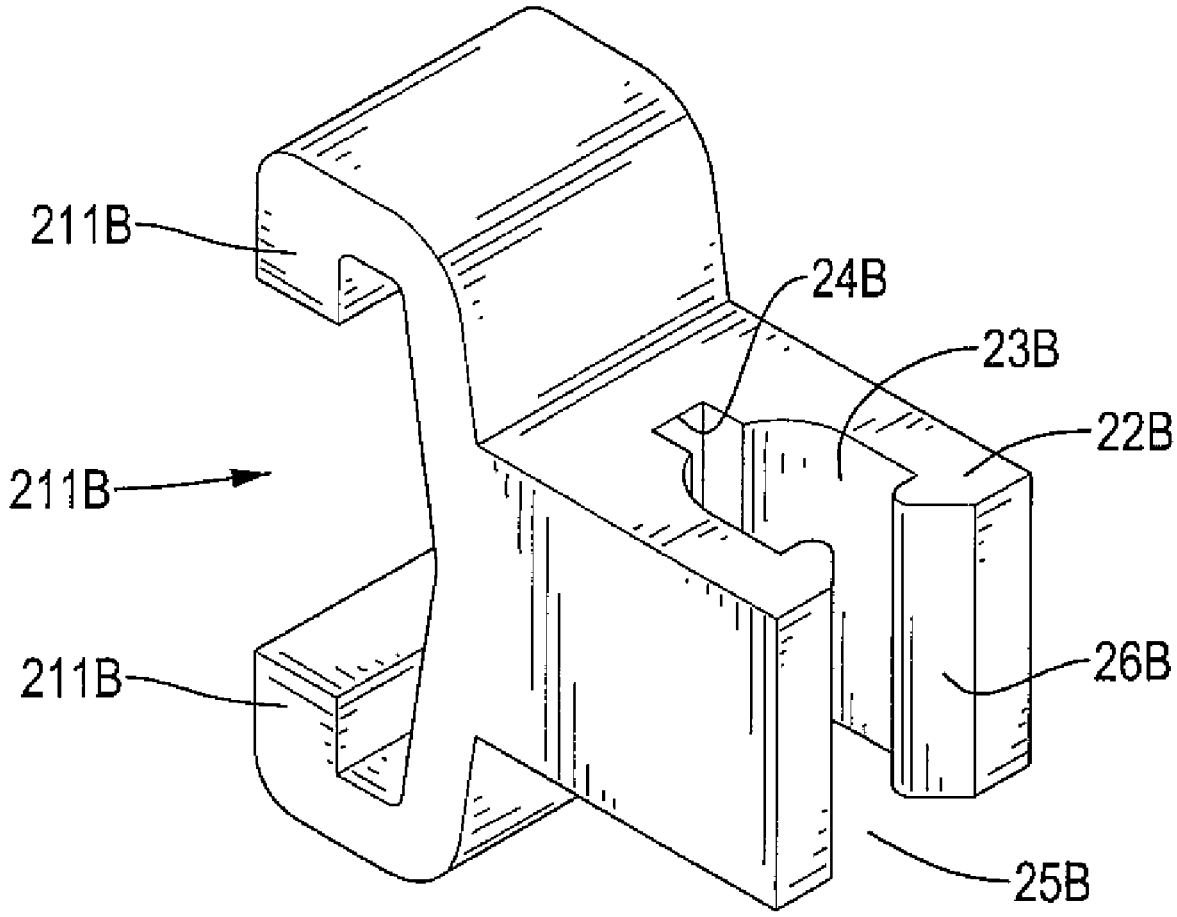
FIG. 10 is a perspective view of the clamping element in FIGS. 9A and 9B.
Figure 11A:
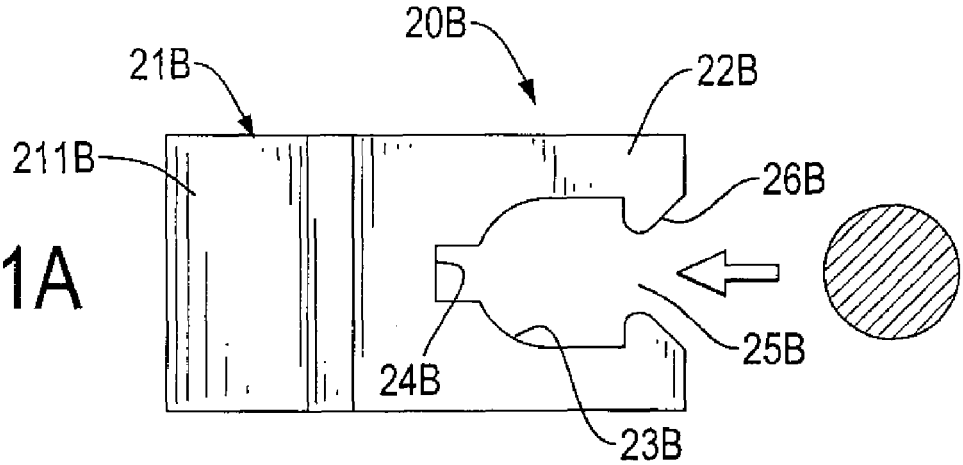
FIGS. 11A, 11B and 11C are top views in cross section showing the attachment/detachment of the hand tool by the clamping element in FIG. 10.
Figure 11B:
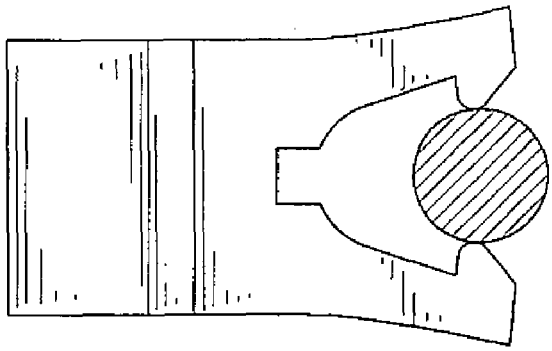
Figure 11C:
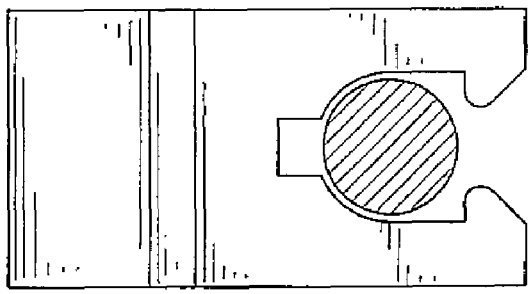
Figure 12B:
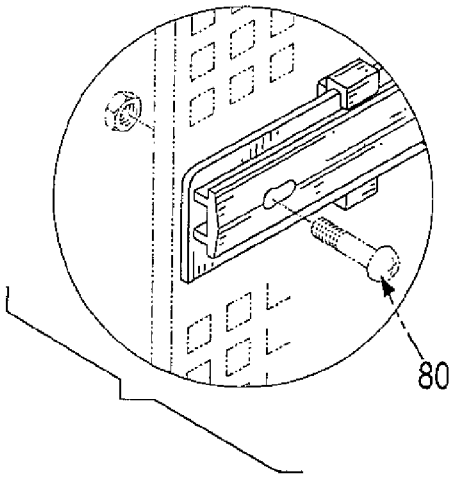
FIG. 12B is an exploded perspective view showing the hand tool rack affixed to the wall via a threaded bolt.
Figure 12A:
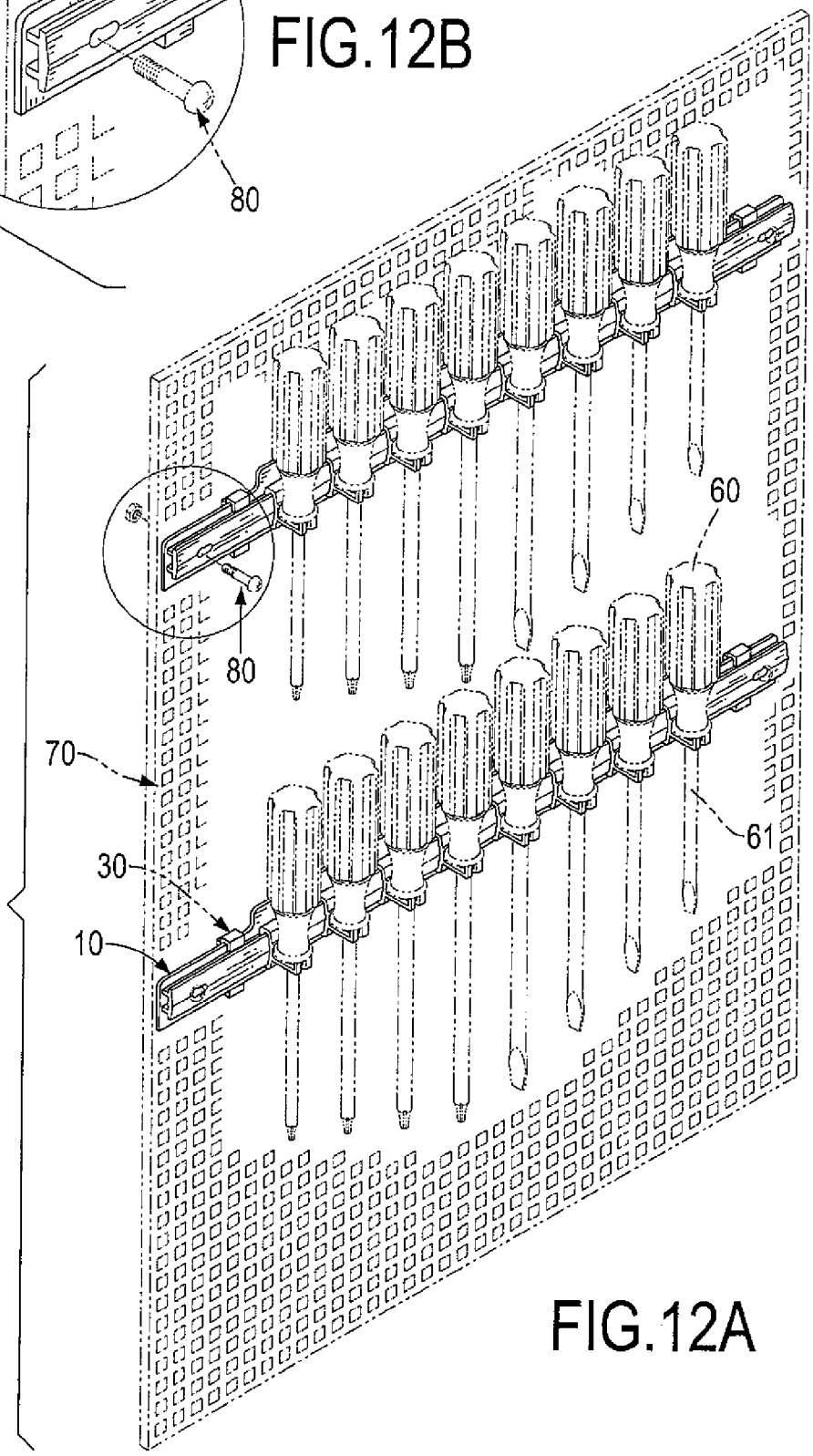
FIG. 12A is a perspective view showing the hand tool rack mounted on a wall.

With further reference to FIGS. 5, 8 and 10, the clamping elements (20, 20A, 20B) are movably mounted on the rail bracket (12) of the base bracket (10) and each clamping element (20, 20A, 20B) has a clamping arm (21, 21A, 21B), a tool mount (22, 22A, 22B), a tool hole (23, 23A, 23B), a tool slot (24, 24A, 24B), a mounting slit (25, 25A, 25B) and a guiding face (26B).

The clamping arm (21, 21A, 21B) is mounted slidably on, clamps on the rail bracket (12) of the base bracket (10) and has at least one hook (211, 211A, 211B) clamped on the rail (121) of the rail bracket (12).

The tool mount (22, 22A, 22B) is formed on and protrudes from the clamping arm (21, 21A, 21B) for holding hand tools (60) and has an upper surface, a lower surface and a front surface.

The tool hole (23, 23A, 23B) is formed through the upper surface and the lower surface of the tool mount (22, 22A, 22B).

The tool slot (24, 24A, 24B) is formed through the upper surface and the lower surface of the tool mount (22, 22A, 22B), is adjacent to and communicates with the tool hole (23, 23A, 23B).

The mounting slit (25, 25A, 25B) is formed through the upper surface, the front surface and the lower surface of the tool mount (22, 22A, 22B) and communicates with the tool hole (23, 23A, 23B) opposite to the tool slot (24, 24A, 24B).

The guiding face (26B) is formed on the front surface of the tool mount (22B) to provide a guiding effect to aid mounting the hand tools (60) in the tool hole (23B) via the mounting slit (25B).

The hangers (30) are movably mounted on the base bracket (10) and each hanger (30) has a front side, a rear side, two mounting arms (31) and a hanging arm (32).

The mounting arms (31) are formed on and protrude from the front side of the hanger (30) and are clamped on the rear surface of the baseboard (11).

The hanging arm (32) is formed on and protrudes from the rear side of the hanger (30) for hanging on the sidewall (91) of the tool cart (90).

The lock (40) is detachably connected to the base bracket (10) to provide a burglarproof effect and has a display clamp (41) and a container clamp (42).

The display clamp (41) is detachably connected to a corresponding end of the base bracket (10) and has a display panel (411) and a catching bracket (412).

The display panel (411) is attached to the baseboard (11) of the base bracket (10) and has a connecting end, a hanging end, a front surface, a mounting protrusion (413), a holding frame (414) and a hanging hole (415). The connecting end of the display panel (411) is connected to the corresponding end of the base bracket (10).

The mounting protrusion (413) is formed on and protrudes from the front surface of the display panel (411), is mounted in the elongated hole (112) of the baseboard (11) and the corresponding connecting hole (123) of the rail bracket (12) near the corresponding end of the base bracket (10).

The holding frame (414) is formed on the front surface of the display panel (411) at the connecting end and has an inner side, two mounting slots (416) and two holding protrusions (417). The mounting slots (416) are formed in the inner side of the holding frame (414), are parallel with each other and each mounting slot (416) has an opening. The openings face to the hanging end of the display panel (411). The holding protrusions (417) are formed on and protrude from the front surface of the display panel (411) near the openings of the mounting slots (416).

The hanging hole (415) is formed through the hanging end of the display panel (411) for hanging and displaying the hand tool rack on a wall (70).

The catching bracket (412) may be U-shaped, is detachably connected to the display panel (411) around the rail bracket (12) and has two free ends, two mounting panels (418) and two engaging plates (419). The free ends of the catching bracket (412) are attached to the connecting end of the display panel (411). The mounting panels (418) are formed on the free ends of the catching bracket (412), are mounted in the mounting slots (416) of the holding frame (414) via the openings and each mounting panel (418) has a mounting end. The engaging plates (419) are respectively formed on the mounting ends of the mounting panels (418) and engage the holding protrusions (417) of the holding frame (414). Then, the catching bracket (412) is securely attached to the display panel (411) by the holding protrusions (417) engaging the engaging plates (419) to prevent the clamping elements (20, 20A, 20B) becoming detached from the corresponding end of the base bracket (10).

The container clamp (42) is detachably connected to a corresponding end of the base bracket (10) for storing fasteners (80) such as bolts or nuts and has a container panel (421) and a container casing (422).

The container panel (421) is attached to the baseboard (11) of the base bracket (10) and has an inner end, an outer end, a middle, a front surface, a mounting protrusion (423) and a holding frame (424). The inner end of the container panel (421) is connected to the corresponding end of the base bracket (10).

The mounting protrusion (423) is formed on and protrudes from the front surface of the container panel (421) near the outer end, is mounted in the elongated hole (112) of the baseboard (11) and the corresponding connecting. hole (123) of the rail bracket (12) near the corresponding end of the base bracket (10).

The holding frame (424) is formed on the front surface of the container panel (421) near the middle and has an inner side, two mounting slots (425) and two holding protrusions (426). The mounting slots (425) are formed in the inner side of the holding frame (424), are parallel with each other and each mounting slot (425) has an opening. The openings face the inner end of the container panel (421). The holding protrusions (426) are formed on and protrude from the front surface of the container panel (421) near the openings of the mounting slots (425).

The container casing (422) may be U-shaped, is detachably connected to the container panel (421) around the rail bracket (12) and has two free ends, two mounting panels (427), two engaging plates (428) and a chamber (429). The free ends of the container casing (422) are attached to the middle of the container panel (421). The mounting panels (427) are formed on the free ends of the container casing (422), are mounted in the mounting slots (425) of the holding frame (424) via the openings and each mounting panel (427) has a mounting end. The engaging plates (428) are respectively formed on the mounting ends of the mounting panels (427) and engage the holding protrusions (426) of the holding frame (424). The chamber (429) is formed in the container casing (422). Then, the container casing (422) is securely attached to the container panel (421) by the holding protrusions (426) engaging the engaging plates (428) to prevent the clamping elements (20, 20A, 20B) becoming detached from the corresponding end of the base bracket (10) and the chamber (429) of the container casing (422) can be used to store fasteners such bolts or nuts.

With reference to FIGS. 4A, 4B, 7A, 7B, 9A and 9B, each clamping element (20, 20A, 20B) can be adjusted to change a position relative to the base bracket (10) by moving the clamping arm (21, 21A, 21B) of the clamping element (20, 20A, 20B) relative to the rail (121) of the rail bracket (12) and a hand tool (60) can be mounted in the tool hole (23, 23A, 23B) from the upper surface or the mounting slit (25, 25A, 25B) of the tool mount (22, 22A, 22B), then a shank (61) of the hand tool (60) can be held with the clamping element (20, 20A, 20B).

Furthermore, with reference to FIGS. 6A, 6B, 6C, 11A, 11B and 11C, the tool slot (24, 24A, 24B) of the clamping element (20, 20A, 20B) may deform elastically when the hand tool (60) mounted in the tool hole (23, 23A, 23B) via the mounting slit (25, 25A, 25B) to clamp the shank (61) of the hand tool (60) securely in the tool hole (23, 23A, 23B). In addition, the guiding face (26B) of the clamping element (20B) can provide a guiding effect when the hand tool (60) is mounted in the tool hole (23B) via the mounting slit (25B).

With reference to FIGS. 2, 3, 12A and 12B, removing the holding protrusions (417, 426) from the display panel (411) and the container panel (421), then the catching bracket (412) and the storing casing (422) can be respectively separated from the display panel (411) and the container panel (421). When the mounting protrusions (413, 423) are separated from the elongated holes (112) of the baseboard (11) and the connecting holes (123) of the rail bracket (12), the display clamp (41) and the container clamp (42) of the lock (40) can separate from the base bracket (10).

After the lock (40) is separated from the base bracket (10), the base bracket (10) of the hand tool rack can be mounted on a wall (70) by fasteners (80), which are stored in the chamber (429) of the container casing (422), through the elongated holes (112) of the baseboard (11) and the connecting holes (123) of the rail bracket (12). Then, the base bracket (10) can be securely mounted on the wall (70).

Figure 13A:
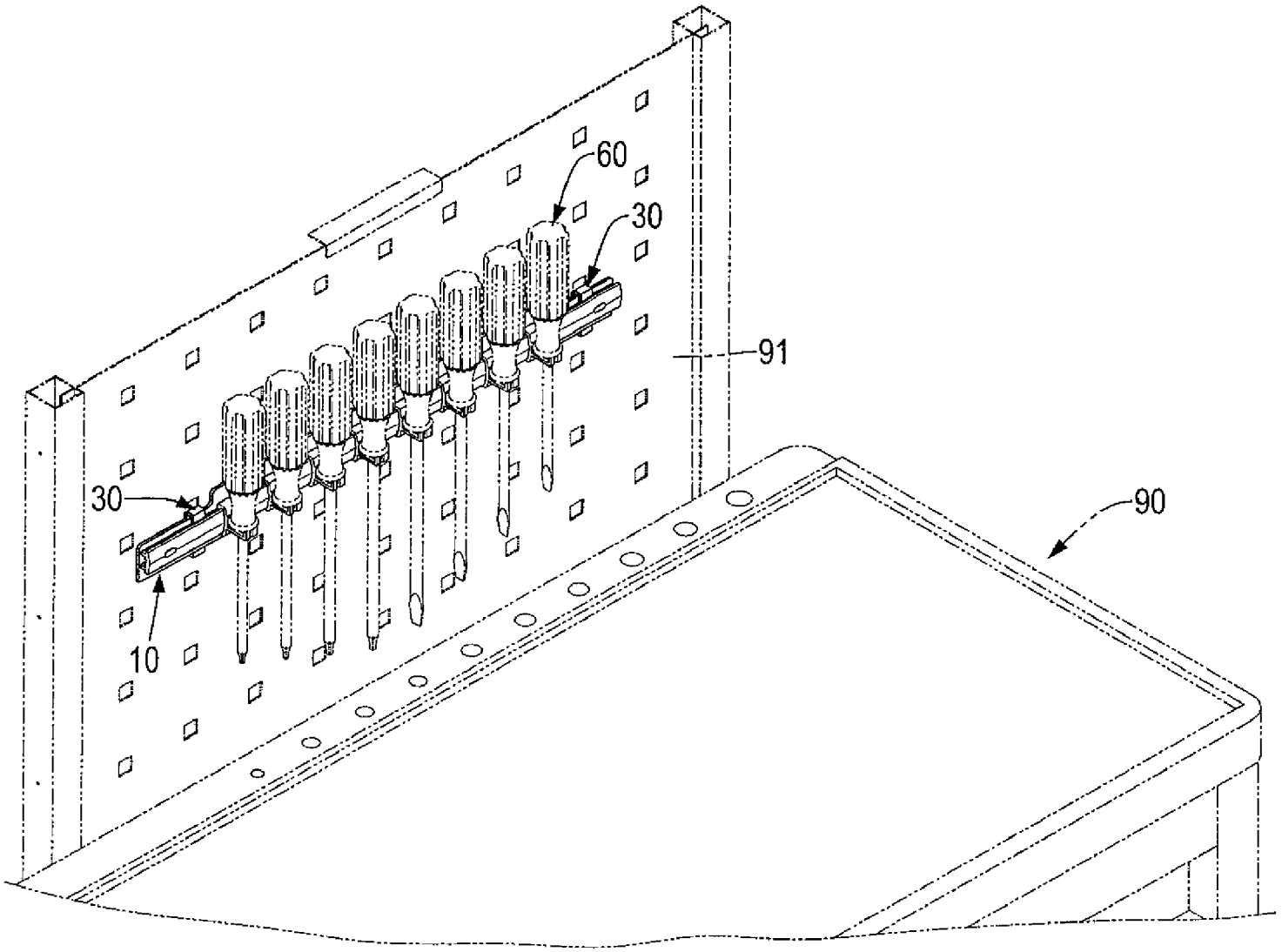
FIG. 13A is a perspective front view showing the hand tool rack mounted on a tool cart.
Figure 13B:
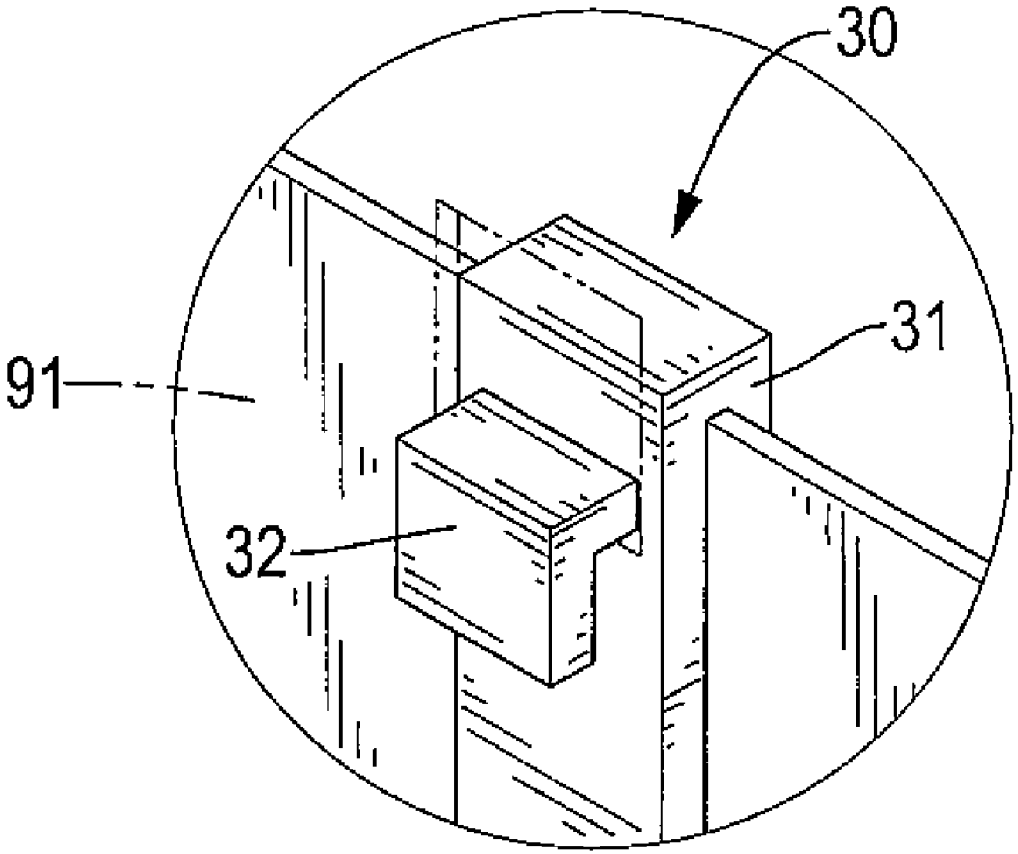
FIG. 13B is an enlarged rear perspective view showing the hand tool rack is mounted on a tool cart via hangers of the hand tool rack.

With reference to FIGS. 13A and 13B, the base bracket (10) also can be mounted on a tool cart (90) by the mounting arms (32) of the hangers (30) hanging on a sidewall (91) of the tool cart (90), and the base bracket (10) can hang on the tool cart (90) for clamping hand tools (60).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hand tool rack comprising:

an elongated base bracket having two ends, a baseboard having a front surface, a rear surface, a connecting bar being longitudinally formed on and protruding from the front surface of the baseboard and having a front surface, and two ends, and two elongated holes being respectively formed through the connecting bar and the baseboard near the ends of the connecting bar, and a rail bracket being detachably mounted on the baseboard and having a rail being mounted on the front surface of the connecting bar of the baseboard and having a rear surface, two ends, and two connecting holes being respectively formed through the rail near the ends and aligning with the elongated holes of the baseboard, and two mounting panels being respectively formed on and protruding from the rear surface of the rail parallel to each other and being mounted on opposite sides of the connecting bar of the baseboard;

multiple clamping elements being movably mounted on the rail bracket of the base bracket and each clamping element having a clamping arm being mounted slidably on and clamping on the rail of the rail bracket of the base bracket, a tool mount being formed on and protruding from the clamping arm for holding hand tools and having an upper surface, a lower surface, and a front surface, a tool hole being formed through the upper surface and the lower surface of the tool mount, a tool slot being formed through the upper surface and the lower surface of the tool mount, adjacent to and communicating with the tool hole, and a mounting slit being formed through the upper surface, the front surface and the lower surface of the tool mount and communicating with the tool hole opposite to the tool slot;

two hangers being movably mounted on the base bracket and each hanger having a front side, a rear side, two mounting arms being formed on and protruding from the front side of the hanger and being clamped on the rear surface of the baseboard, a hanging arm being formed on and protruding from the rear side of the hanger;

a lock being detachably connected to the base bracket to provide a burglarproof effect and having a display clamp being detachably connected to a corresponding one of the ends of the base bracket and having a display panel being attached to the baseboard of the base bracket and having a connecting end being connected to the corresponding end of the base bracket, a hanging end, a front surface, a mounting protrusion being formed on and protruding from the front surface of the display panel, being mounted in the elongated hole of the baseboard and the connecting hole of the rail bracket near the corresponding end of the base bracket, and a holding frame being formed on the front surface of the display panel at the connecting end and having an inner side, two mounting slots being formed in the inner side of the holding frame parallel with each other and each mounting slot having an opening facing the hanging end of the display panel, and two holding protrusions being formed on and protruding from the front surface of the display panel near the openings of the mounting slots, and a hanging hole being formed through the hanging end of the display panel; and a catching bracket being U-shaped, being detachably connected to the holding frame of the display panel around the rail bracket and having two free ends being attached to the connecting end of the display panel, two mounting panels being formed on the free ends of the catching bracket, mounted in the mounting slots of the holding frame via the openings and each mounting panel having a mounting end, and two engaging plates being respectively formed on the mounting ends of the mounting panels and engaging the holding protrusions of the holding frame;

a container clamp being detachably connected to a corresponding one of the ends of the base bracket and having a container panel being attached to the baseboard of the base bracket and having an inner end being connected to the distal end of the base bracket an outer end, a middle, a front surface, a mounting protrusion being formed on and protruding from the front surface of the container panel near the outer end, being mounted in the elongated hole of the baseboard and the connecting hole of the rail bracket near the corresponding end of the base bracket, and a holding frame being formed on the front surface of the container panel near the middle; and a container casing being detachably connected to the holding frame of the container panel around the rail bracket, wherein the holding frame of the container panel has an inner side, two mounting slots being formed in the inner side of the holding frame parallel with each other and each mounting slot having an opening facing the inner end of the container panel, and two holding protrusions being formed on and protruding from the front surface of the container panel near the openings of the mounting slots, and the container casing is U-shaped and has two free ends being attached to the middle of the container panel, two mounting panels being formed on the free ends of the container casing, mounted in the mounting slots of the holding frame via the openings and each mounting panel having a mounting end, two engaging plates being respectively formed on the mounting ends of the mounting panels and engaging the holding protrusions of the holding frame, and a chamber being formed in the container casing.

2. The hand tool rack as claimed in claim 1, wherein each clamping element has a guiding face formed on the front surface of the tool mount.

3. The hand tool rack as claimed in claim 2, wherein the clamping arm of each clamping element has two hooks clamped on the rail of the rail bracket.

4. The hand tool rack as claimed in claim 2, wherein the clamping arm of each clamping element has a hook clamped on the rail of the rail bracket.

* * * * *